US006089704A

United States Patent [19]

Burns et al.

[11] Patent Number: 6,089,704

[45] Date of Patent: Jul. 18, 2000

[54] OVERCOAT FOR INK JET RECORDING ELEMENT

[75] Inventors: Elizabeth G. Burns, Salem, N.H.; John Dicillo; Lori J. Shaw-Klein, both of Rochester, N.Y.

[73] Assignee: Eastman Kodak Company, Rochester, N.Y.

[21] Appl. No.: 09/175,132

[22] Filed: Oct. 19, 1998

[51] Int. Cl.[7] ..... B41M 5/00; B41J 2/01

[52] U.S. Cl. ..... 347/105; 428/211; 428/474.4; 428/478.2; 428/480; 428/483; 428/500; 428/516; 428/518; 428/522

[58] Field of Search ..... 347/105; 428/211, 428/474.4, 478.2, 480, 483, 500, 516, 518, 522

[56] References Cited

U.S. PATENT DOCUMENTS 4,686,118 8/1987 Arai et al. ..... 428/195

FOREIGN PATENT DOCUMENTS 0 791 475 A2 8/1997 European Pat. Off. .

*Primary Examiner*—Pamela R. Schwartz
*Attorney, Agent, or Firm*—Harold E. Cole

[57] ABSTRACT

An ink jet recording element comprising the following layers in the order recited:

a) a support;

b) a hydrophilic image-recording layer; and c) an overcoat layer comprising a vinyl latex polymer having the following formula:

$$—A_x—B_y—C_z—$$

wherein:

A is a hydrophilic, vinyl monomer;

B is a hydrophobic, vinyl monomer;

C is a cationic monomer;

x is from about 1 to about 80 mole %;

y is from about 10 to about 80 mole %; and z is from about 2 to about 20 mole %.

15 Claims, No Drawings

OVERCOAT FOR INK JET RECORDING ELEMENT

CROSS REFERENCE TO RELATED APPLICATION

Reference is made to commonly-assigned U.S. patent application Ser. No. 09/174,946 pending, filed of even date herewith, entitled Ink Jet Recording Element, by Shaw-Klein et al., the teachings of which are incorporated herein by reference.

FIELD OF THE INVENTION

The present invention relates generally to an ink jet image-recording element which yields printed images with high optical densities, excellent image quality, higher gloss, and fast drying.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-recording layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Provide maximum printed optical densities
- Exhibit the ability to absorb high concentrations of ink and dry quickly to avoid elements blocking together when stacked against subsequent prints or other surfaces
- Provide a high level of gloss and avoid differential gloss
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light

DESCRIPTION OF RELATED ART

EP 0 791 475 discloses an ink jet receiving layer comprising a combination of two solution polymers (polyalkylene oxide and gelatin) and a polymeric latex. This ink jet receiving layer may be subsequently overcoated with a combination of a solution polymer and a latex polymer. There is a problem with this receiver, however, in that dyes are not chemically bound to it and can subsequently transfer to unwanted surfaces.

It is an object of this invention to provide an ink jet recording element which will retain an ink jet image transferred to it. It is another object of this invention to provide and ink jet recording element which has a high gloss and fast dry time without having a high viscosity.

SUMMARY OF THE INVENTION

These and other objects are achieved in accordance with this invention which relates to an ink jet recording element comprising the following layers in the order recited:

a) a support;

b) a hydrophilic image-recording layer; and c) an image-recording layer comprising a vinyl, latex polymer having the following formula:

$$—A_x—B_y—C_z—$$

wherein:

A is a hydrophilic, vinyl monomer such as hydroxyethylacrylate, hydroxyethylmethacrylate, acrylic acid, methacrylic acid, acrylic acid, vinyl alcohol, acrylamide, methacrylamide or hydroxyethylacrylamide;

B is a hydrophobic, vinyl monomer such as methylacrylate, methylmethacyrlate, butylacrylate, butylmethacrylate, ethylacrylate, ethylmethacrylate, isopropylacrylate, cyclohexylacrylate, norbornylacrylate, vinylacetate, vinylneodeconate or styrene;

C is a cationic monomer such as trimethylammonium ethylacrylate chloride, trimethylammonium ethylacrylate methylsulfate, trimethylammonium methylacrylate chloride, trimethylammonium ethylmethacrylate methylsulfate, methylvinylpyridinium chloride, methylimidazolium iodide or trimethylammonium ethylacrylamide chloride;

x is from about 10 to about 80 mole %;

y is from about 10 to about 80 mole %; and z is from about 2 to about 20 mole %.

The recording element of the invention exhibits high gloss and a fast dry time which is preferred for photographic quality ink jet printing imaging, without the high viscosities encountered when manufacturing coated layers originating from solution polymers. Such an approach allows for deposition of the layer from higher-solids melts and requires less energy to drive off the coating solvent. In turn, this approach allows for higher coating speeds resulting in a more economically attractive product than those using solution polymers.

DETAILED DESCRIPTION OF THE INVENTION

In a preferred embodiment of the invention, A is a hydrophilic, vinyl monomer that is nonionic at pH 2. In another preferred embodiment, A is an acrylic monomer. In still another preferred embodiment, B is an acrylate monomer. In yet another preferred embodiment, x is from about 10 to about 50 mole %, y is from about 40 to about 70 mole % and z is from about 5 to about 15 mole %.

Examples of the vinyl latex polymer useful in the invention include the following:

$$—A_x—B_y—C_z—$$

TABLE 1

| | Monomer (mole %) | Tg | % Solids | Particle Size |
|---|---|---|---|---|
| L-1 | Hydroxyethylacrylate (45)<br>Methylmethacrylate (45)<br>Trimethylammoniumethylacrylate, Methylsulfate salt (10) | −47 | 24 | 184 |
| L-2 | Methacrylic acid (45)<br>Methylmethacrylate (45)<br>Trimethylammoniumethylacrylate, Methylsulfate salt (10) | None Obs. | 20 | 72 |
| L-3 | Hydroxyethylacrylate (45)<br>Butylacrylate (45)<br>Trimethylammoniumethylacrylate, Methylsulfate salt (10) | −34 | 24 | 337 |
| L-4 | Methacrylic acid (45)<br>Butylacrylate (45)<br>Trimethylammoniumethylacrylate, Methylsulfate salt (10) | 45 | 22 | 86 |
| L-5 | Hydroxyethylacrylate (45)<br>Methylmethacrylate (45)<br>Trimethylammoniumethylacrylate, chloride salt (10) | 60 | 25 | — |
| L-6 | Methacrylic acid (45)<br>Methylmethacrylate (45)<br>Trimethylammoniumethylacrylate, chloride salt (10) | none obs. | 20 | — |
| L-7 | Hydroxyethylacrylate (45)<br>Butylacrylate (45)<br>Trimethylammoniumethylacrylate, chloride salt (10) | −40 | 26 | 286 |
| L-8 | Methacrylic acid (45)<br>Butylacrylate (45)<br>Trimethylammoniumethylacrylate, chloride salt (10) | none obs. | 23 | 110 |
| L-9 | Acrylic acid (45)<br>Methylmethacrylate (45)<br>Trimethylammoniumethylacrylate, chloride salt (10) | 119 | 19 | — |
| L-10 | Methacrylic acid (45)<br>Ethylmethacrylate (45)<br>Trimethylammoniumethylacrylate, chloride salt (10) | none obs. | 23 | — |
| L-11 | Methacrylic acid (45)<br>Benzylacrylate (45)<br>Trimethylammoniumethylacrylate, chloride salt (10) | 55 | 22 | — |
| L-12 | Acrylic acid (45)<br>Methylacrylate (45)<br>Trimethylammoniumethylacrylate, chloride salt (10) | 80 | 18 | — |
| L-13 | Acrylic acid (45)<br>Ethylmethacrylate (45)<br>Trimethylammoniumethylacrylate, chloride salt (10) | 85 | 21 | — |
| L14 | Methacrylic acid (20)<br>Methylmethacrylate (70)<br>Trimethylammoniumethylacrylate, chloride salt (10) | 133 | 23 | — |
| L-15 | Methacrylic acid (30)<br>Methylmethacrylate (60)<br>Trimethylammoniumethylacrylate, chloride salt (10) | 149 | 22 | — |
| L16 | Methacrylic acid (50)<br>Methylmethacrylate (40)<br>Trimethylammoniumethylacrylate, chloride salt (10) | 150 | 21 | — |
| L-17 | Methacrylic acid (70)<br>Butylacrylate (20)<br>Trimethylammoniumethylacrylate, chloride salt (10) | none obs. | 22 | — |

TABLE 1-continued

| | Monomer (mole %) | Tg | % Solids | Particle Size |
|---|---|---|---|---|
| L-18 | Methacrylic acid (30)<br>Butylacrylate (60)<br>Trimethylammoniumethylacrylate, chloride salt(10) | 11 | 25 | — |
| L-19 | Methacrylic acid (20)<br>Butylacrylate (80)<br>Trimethylammoniumethylacrylate, chloride salt (10) | −28 | 25 | — |
| L-20 | Butylacrylate (60)<br>Methacrylic acid (30)<br>Trimethylammoniumethylacrylate, chloride salt (10) | 24.2 | 9.3 | 175 |
| L-21 | Butylacrylate (70)<br>Methacrylic acid (20)<br>Trimethylammoniumethylacrylate, chloride salt (10) | 25.0 | 20 | 250 |
| L-22 | Butylacrylate (80)<br>Methacrylic acid (10)<br>Trimethylammoniumethylacrylate, chloride salt (10) | 26.5 | 22 | 298 |
| L-23 | Butylacrylate (90)<br>Trimethylammoniumethylacrylate, chloride salt (10) | 26.6 | 21 | 193 |
| L-24 | Butylacrylate (60)<br>Methacrylic acid (20)<br>Methylmethacrylate (10)<br>Trimethylammoniumethylacrylate, chloride salt (10) | 24.4 | 21 | 263 |
| L-25 | Butylacrylate (60)<br>Methacrylic acid (15)<br>Methylmethacrylate (15)<br>Trimethylammoniumethylacrylate, chloride salt (10) | 24.1 | 21 | 210 |
| L-26 | Butylacrylate (60)<br>Methacrylic acid (10)<br>Methylmethacrylate (20)<br>Trimethylammoniumethylacrylate, chloride salt (10) | 24.6 | 20 | 119 |
| L-27 | Butylacrylate (60)<br>Methylmethacrylate (30)<br>Trimethylammoniumethylacrylate, chloride salt (10) | 25.5 | 20 | 106 |

The vinyl latex polymer may be employed in an amount of from about 2.5 to about 25 g/m$^2$, preferably from about 0.5 to about 1.5 g/m$^{22}$.

The vinyl latex polymer used in the invention is the result of an emulsion polymerization. This includes both the solid polymer particles suspended in water and any water soluble polymers that may also be present in the water at the end of the reaction. Emulsion polymerization of vinyl monomers is described in Emulsion Polymerization and Emulsion Polymers by Lovell and El-Asser.

While the polymeric latex may be successfully coated from any liquid in which it remains stable, water is a preferred coating solvent due to its innocuous nature. The coating composition may be formulated at any solids content desired to yield a particular dry coverage, but given their relatively low viscosities, polymeric lattices may be coated from high solids, up to 50 weight per cent, such that the wet coverage is low and less energy and time is required to effectively dry the coating. Preferred compositions range from 10–20 weight per cent solids in water. Additives known in the coating art may be included in the coating formulation, such as surfactants, lubricants, defoamers, matte particles, coalescing aids, cross-linkers, and the like.

The polymeric latex used in the invention result in glossy, fast drying ink receiving layers, particularly when used as a top coat over a highly swellable, hydrophilic base layer. The combination of monomers used to form such a latex must be carefully selected such that the material is glossy, tack resistant and not water soluble (hydrophobic segment), allows for the passage of ink solvents, mostly water (hydrophilic segment) and allows for the immobilization of typical ink jet dyes in order to give the impression of fast drying (cationic segment). Furthermore, the polymer must be designed such that the minimum film formation temperature of the latex is sufficiently low that a glossy, continuous film results under typical coating and drying conditions.

In general, latex particles useful in the invention contain three components which have shown good success. A hydrophobic monomer is used to provided a latex and to reduce tackiness. Tg may be controlled by the choice of this monomer. A hydrophilic, but not ionic monomer is used to increase adhesion and provide good dry times. Finally a small quantity of cationic monomer is typically used to contribute to particle stability.

Latex particles are stabilized by the use of surfactants in the polymerization, which remain in the finished latex. They may be used at any level that provides a good particle size and good particle stability, generally five weight percent or less. Useful surfactants may be anionic, cationic or nonionic. Cationic surfactants in receiver overcoats work well with the anionic dyes used in many ink jet inks. Examples of cationic surfactants include cetyltrimethylammonium bromide and Ethoquod® O/12. These cationic surfactants may also be used with additional nonionic surfactant with good results.

The vinyl latex polymer used in the invention may be optionally stabilized by the use of an appropriately charged monomer. In conjunction with the cationically charged surfactant, quaternary ammonium acrylates have been used.

The vinyl latex polymers can be made by mixing the monomers in one feed stream and contain 2–4 monomers, but any number of compatible monomers can be used to achieve desired levels of hydrophillicity, glass transition temperature, adhesion to the bottom layer, blocking, tackiness, gloss, dry time or any other desired property.

Any support or substrate may be used in the recording element of the invention. There may be used, for example, plain or calendered paper, paper coated with protective polyolefin layers, polymeric films such as polyethylene terephthalate, polyethylene naphthalate, poly 1,4-cyclohexane dimethylene terephthalate, polyvinyl chloride, polyimide, polycarbonate, polystyrene, or cellulose esters. In a preferred embodiment of the invention, support materials should be selected such that they permit a glossy finish capable of rendering a photographic quality print. In particular, resin-coated paper is preferred.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layer and overcoat may be simultaneously applied. After coating, the layer is generally dried by simple evaporation, which may be accelerated by known techniques such as convection heating.

In order to obtain adequate coatability, additives known to those familiar with such art such as surfactants, defoamers, alcohol and the like may be used. A common level for coating aids is 0.01 to 0.30 per cent active coating aid based on the total solution weight. These coating aids can be nonionic, anionic, cationic or amphoteric. Specific examples are described in MCCUTCHEON's Volume 1: Emulsifiers and Detergents, 1995, North American Edition.

The support is suitably of a thickness of from about 50 to about 500 μm, preferably from about 75 to 300 μm. Antioxidants, antistatic agents, plasticizers and other known additives may be incorporated into the support, if desired.

In order to improve the adhesion of the image-recording layer to the support, the surface of the support may be subjected to a corona-discharge-treatment prior to applying the image-recording layer.

In addition, a subbing layer, such as a layer formed from a halogenated phenol or a partially hydrolyzed vinyl chloride-vinyl acetate copolymer can be applied to the surface the support to increase adhesion of the solvent-absorbing layer. If a subbing layer is used, it should have a thickness (i.e., a dry coat thickness) of less than about 2 μm.

Optionally, an additional backing layer or coating may be applied to the backside of a support (i.e., the side of the support opposite the side on which the image-recording layer is coated) for the purposes of improving the machine-handling properties and curl of the recording element, controlling the friction and resistivity thereof, and the like. Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 2 percent by weight of the binder component and the average particle size of the filler material is in the range of 5 to 15 μm, preferably 5 to 10 μm. Typical binders used in the backing layer are polymers such as acrylates, gelatin, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octylsulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder.

Materials useful as the hydrophilic image-recording layer of the invention may be naturally occurring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers.

While not necessary, the hydrophilic film forming binder may also include a crosslinker. Such an additive can improve the adhesion of the ink receptive layer to the substrate as well as contribute to the cohesive strength and water resistance of the layer. Crosslinkers such as carbodimides, polyfunctional aziridines, melamine formaldehydes, isocyanates, epoxides, polyvalent metal cations, and the like may be used. If a crosslinker is added, care must be taken that excessive amounts are not used as this will decrease the swellability of the layer, reducing the drying rate of the printed areas.

The hydrophilic image-recording layer may be present in any amount which is effective for the intended purpose. In general, it may be present in an amount of from about 0.5 to about 20 g/m$^2$, preferably from about 1 to about 10 g/m$^2$, which corresponds to a dry thickness of about 0.5 to about 20 $\mu$m, preferably about 2 to about 10 $\mu$m.

The hydrophilic image-recording layer used in the recording elements of the present invention can also contain various known additives, including matting agents such as titanium dioxide, zinc oxide, silica and polymeric beads such as crosslinked poly(methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; viscosity modifiers; dye-fixing agents; waterproofing agents; dispersing agents; UV-absorbing agents; mildew-proofing agents; mordants; antistatic agents, anti-oxidants, optical brighteners, and the like. Such additives can be selected from known compounds or materials in accordance with the objects to be achieved.

Waterfastness can be imparted to the hydrophilic image-recording layer through appropriate selection and addition of dye mordants. For example, if the dyes are primarily anionic (as are typical in commercially available desktop ink jet printers), quaternary ammonium or phosphonium containing polymers, surfactants, etc. may be added. Alternately, other mordanting materials well known in the art may be selected, such as amine-containing polymers or simply a polymer or species carrying positive charges. For example, inorganic particulates with high points of zero charge may be selected such that their surfaces are positively charged under most conditions. A common example of such a mineral mordant is boehmite.

In the present invention, when the ink is ejected from the nozzle of the ink jet printer in the form of individual droplets, the droplets pass through the image-recording layer where most of the dyes in the ink are retained or mordanted while the remaining dyes and the solvent or carrier portion of the ink pass freely through the image-recording layer to the solvent-absorbing layer where they are rapidly absorbed. In this manner, large volumes of ink are quickly absorbed by the recording elements of the present invention giving rise to high quality recorded images having excellent optical density and good color gamut.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Synthesis of Latex Particles L-1–L-8

Latex L-1 was made by purging 250 mL of distilled water with nitrogen in a 1 L 3-neck reaction flask equipped with an overhead stirrer and an addition/inlet adapter. Cetyltrimethylammonium bromide (3.5 g) was added to the nitrogen purged water. The reaction flask was then warmed to and held at 80 C. Distilled water, 115 mL, was purged with nitrogen in a 2 L 3-neck addition funnel equipped with an overhead stirrer and pump. To the nitrogen purged water was added, in this order, 3.5 cetyltrimethylammonium bromide, trimethylammonium-methyl acrylate, methylsulfate salt (28.32 g, 0.1 mole), hydroxyethylacrylate (52 g, 0.45 mole) and methylmethacrylate (47 g, 0.45 mole.) The monomers were stirred with the water and surfactant for fifteen minutes. Initiator, 2,2'-azobis(2-methylpropionamidine) dihydrochloride, (1.28 g) was added to the reaction flask and monomer addition started immediately at a rate of 7.5 mL/min. When the addition of monomer was complete, another 1.28 g of the initiator was added to the reaction flask and the reaction mixture stirred at 80 C for two hours. The flask was then removed from the heat and cooled before filtering through polypropylene filter media. This latex was 24% solids and had a particle size of 184 nm. The isolated polymer had a Tg of −47 C.

Latex's 2–19 were made in the same way, using the monomer ratios shown in the above Table 1.

Latex particles L-20–27 were made according to the procedure given for L-1 except that 1.23 g of Ethoquod® O/12 (Armak Inc.) was used instead of cetyltrimethylammonium bromide.

Example 2

Control Receivers CR-1 & CR -2 and Use of Latex's L-1–L-8 to make Ink Jet Receivers R-1–R-8.

In each case, an image-recording layer of Type IV deionized gelatin (Eastman Gelatine Co.) was bead coated to a dry coverage of 8.6 g/m$^2$. Overcoat materials were simultaneously coated to obtain a dry coverage of 1.1 g/m$^2$. The dual layer coatings were chill set at 4 C and further dried by forced air heat until thoroughly dried. For each coating, the substrate was polyethylene resin-coated paper, treated by corona discharge to enhance adhesion.

TABLE 2

| Receiver | Overcoat Polymer |
|---|---|
| CR-1 | A4M |
| CR-2 | LM200 |
| R-1 | L-1 |
| R-2 | L-2 |
| R-3 | L-3 |
| R-4 | L-4 |

TABLE 2-continued

| Receiver | Overcoat Polymer |
|---|---|
| R-5 | L-5 |
| R-6 | L-6 |
| R-7 | L-7 |
| R-8 | L-8 |

Example 3

Evaluation of Receivers R-1–R-8 and Control Receivers.

Each receiver was evaluated for gloss and dry time.

Solids patches of 100% coverage cyan, magenta, yellow and black, and 200% coverage patches of solid red, green and blue were generated using CorelDraw® and printed on each coated sample. Gardner gloss was measured at a 60 degree angle from the perpendicular to the plane of the film for each color and the unprinted area using a Microgloss meter (conforms to ASTM standard D 523). The average of the eight gloss measurements was taken and appears below. Prints were allowed to equilibrate under ambient conditions for at least 48 hours before gloss is measured. For each sample, this process was executed using both an Epson Stylus Color 500 ink jet printer and a Canon BJC 4200 ink jet printer with optional photo inks.

Dry time was evaluated by printing solid strips of color on a Hewlett Packard 850C ink jet printer at 80% RH. Immediately after printing, a sheet of bond paper was pressed against the printed image and a heavy smooth metal roller was passed over the combination. The sheets were separated. The dye offset to the bond paper (cyan, magenta, yellow, and black) was measured by marking the spot on the offset strips corresponding to a printed area 1 minute old, and measuring the optical density of the offset ink for each color. The dry time recorded below corresponds to the average of the four measured densities. The following results were obtained:

TABLE 3

| Receiver | Gloss Epson 500 | Gloss Canon 4200 | Dry Time (Offset Optical Density) HP850 |
|---|---|---|---|
| CR-1 | 80 | 53 | .08 |
| CR-2 | 73 | 85 | .05 |
| R-1 | N/A | N/A | .04 |
| R-2 | 64 | 68 | .03 |
| R-3 | N/A | N/A | .07 |
| R-4 | N/A | N/A | .06 |
| R-5 | N/A | N/A | .05 |
| R-6 | 67 | 63 | .03 |
| R-7 | 35 | 64 | .06 |
| R-8 | N/A | N/A | .04 |

A4M: Methocel ® A4M methyl cellulose,
LM200: Quatrisoft ® LM200 cationic hydroxyethyl cellulose The above results show that the latexes L-1 through L-8 function well as ink jet receivers and are similar in performance to the control receivers.

Example 4

Coating of Ink jet Receivers R-9 through R-23.

Two-layer coatings were produced as described in Example 2 using the same support, coating and drying conditions. However, in this case, the image-recording layer comprised 8.6 g/m$^2$ combination of non-deionized Type IV gelatin (Eastman Gelatine Co.) combined with a cationic mordant (described in U.S. Pat. No. 5,622,808) in a weight ratio of 9:1.

TABLE 4

| Receiver | Overcoat Polymer |
|---|---|
| CR-3 | LM/A4M,80/20 |
| R-9 | L-2 |
| R-10 | L-9 |
| R-11 | L-10 |
| R-12 | L-11 |
| R-13 | L-12 |
| R-14 | L-13 |
| R-15 | L-6 |
| R-16 | L-4 |
| R-17 | L-8 |
| R-18 | L-14 |
| R-19 | L-15 |
| R-20 | L-16 |
| R-21 | L-17 |
| R-22 | L-18 |
| R-23 | L-19 |

Example 5

Evaluation of Ink jet Receivers R-9–R-23.

These receivers were evaluated the same as in Example 3 with the following results:

TABLE 5

| Receiver | Gloss Canon 4200 Photo | Gloss ESC 500 | Dry Time HP 850 |
|---|---|---|---|
| CR-3 | 89 | 88 | .06 |
| R-9 | 77 | 82 | .05 |
| R-10 | 83 | 80 | .14 |
| R-11 | 55 | 77 | .03 |
| R-12 | 62 | 70 | .11 |
| R-13 | 77 | 74 | .14 |
| R-14 | 72 | 72 | .07 |
| R-15 | 74 | 80 | .04 |
| R-16 | 73 | 79 | .05 |
| R-17 | 71 | 76 | .06 |
| R-18 | 63 | 85 | .08 |
| R-19 | 76 | 84 | .07 |
| R-20 | 71 | 83 | .05 |
| R-21 | 66 | 59 | .12 |
| R-22 | 87 | 80 | .08 |
| R-23 | 94 | 82 | .11 |

The above results show that the latexes function well as ink jet receivers and are similar in performance to the control receivers.

Example 6

The following coatings were prepared as in Example 4. The control coating in this case was left without an overcoat for comparison.

TABLE 6

| Receiver | Overcoat Polymer |
|---|---|
| CR-4 | none |
| R-24 | L-20 |
| R-25 | L-21 |
| R-26 | L-22 |
| R-27 | L-23 |
| R-28 | L-24 |
| R-29 | L-25 |
| R-30 | L-26 |
| R-31 | L-27 |

Example 7

Coatings over Pigskin gel

In the following examples, the image-recording layer comprised 100% deionized pigskin gel. Otherwise, coating and testing conditions are identical to those in Examples 2 and 3.

TABLE 7

| Receiver | Overcoat Polymer |
|---|---|
| CR-5 | No overcoat |
| CR-6 | LM/A4M,80/20 |
| R-32 | L-20 |
| R-33 | L-21 |
| R-34 | L-22 |
| R-35 | L-23 |
| R-36 | L-24 |
| R-37 | L-25 |
| R-38 | L-26 |
| R-39 | L-27 |

Example 8

Evaluation of Receivers R-24–R-39.

Samples were evaluated as described in Example 3, except in this set, gloss measurements were made for the Epson Stylus Photo ink jet printer and the Canon BJC 4300 ink jet printer with optional photo inks.

TABLE 8

| Receiver | Gloss Epson Stylus Photo | Gloss Canon 4300 | Dry Time |
|---|---|---|---|
| CR-4 | 63 | 78 | .04 |
| CR-5 | 85 | 90 | .56 |
| CR-6 | 85 | 88 | .16 |
| R-24 | 56 | 75 | .01 |
| R-25 | 60 | 76 | .07 |
| R-26 | 58 | 74 | .04 |
| R-27 | 60 | 72 | .04 |
| R-28 | 74 | 75 | .44 |
| R-29 | 66 | 73 | .16 |
| R-30 | 65 | 74 | .23 |
| R-31 | 62 | 74 | .61 |
| R-32 | 68 | 74 | .58 |
| R-33 | 80 | 89 | .06 |
| R-34 | 77 | 86 | .31 |
| R-35 | 77 | 74 | .34 |
| R-36 | 73 | 94 | .04 |
| R-37 | 77 | 94 | .04 |
| R-38 | 73 | 90 | .03 |
| R-39 | 64 | 70 | .02 |

Example 9

Viscosity

The previous examples show the usefulness of ink receiving layers of the invention comprised entirely of latex polymers. Compared with solution polymers typically used for overcoat materials, such polymers offer the added advantage of substantially lower viscosities at comparable melt solids levels.

Each polymer was diluted to the level indicated below by addition to deionized water. The viscosity at a shear rate of 100 $sec^{-1}$ was measured in centipoise using a Haake rheometer.

TABLE 9

| Overcoat Polymer | % Solids | Viscosity (cp.) |
|---|---|---|
| L-20 | 10 | 2 |
| methyl cellulose | 1.25 | 174 |
| hydroxyethyl cellulose | 2.5 | 174 |
| cationic HEC | 5 | 562 |
| PVP | 10 | 81 |

The above results show that higher solids coatings formulations may be much more easily obtained using the polymeric latex materials of this invention as compared to the solution polymers of the prior art.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising the following layers in the order recited:

a) a support;

b) a hydrophilic image-recording layer; and c) an overcoat layer comprising a vinyl latex polymer having the following formula:

$$—A_x—B_y—C_z—$$

wherein:

A is a hydrophilic, vinyl monomer;

B is a hydrophobic, vinyl monomer;

C is a cationic monomer;

x is from about 1 to about 80 mole %;

y is from about 10 to about 80 mole %; and z is from about 2 to about 20 mole %.

2. The recording element of claim 1 wherein A is a hydrophilic, vinyl monomer that is nonionic at pH 2.

3. The recording element of claim 1 wherein A is an acrylic monomer.

4. The recording element of claim 1 wherein A is hydroxyethylacrylate, hydroxyethylmethacrylate, acrylic acid, methacrylic acid, vinyl alcohol, acrylanide, methacrylamide or hydroxyethylacrylamide.

5. The recording element of claim 1 wherein B is an acrylate monomer.

6. The recording element of claim 1 wherein B is methylacrylate, methylmethacrylate, butylacrylate, butylmethacrylate, ethylacrylate, ethylmethacrylate, isopropylacrylate, cyclohexylacrylate, norbornylacrylate, vinylacetate, vinylneodeconate or styrene.

7. The recording element of claim 1 wherein C is trimethylammonium ethylacrylate chloride, trimethylammonium ethylacrylate methylsulfate, trimethylammonium methylacrylate chloride, trimethylammonium ethylmethacrylate methylsulfate, methylvinylpyridinium chloride, methylimidazolium iodide or trimethylammonium ethylacrylamide chloride.

8. The recording element of claim 1 wherein x is from about 10 to about 50 mole %.

9. The recording element of claim 1 wherein y is from about 40 to about 70 mole %.

10. The recording element of claim 1 wherein z is from about 5 to about 15 mole %.

11. The recording element of claim 1 wherein said support is polyethylene-coated paper or poly(ethylene terephthalate).

12. The element of claim 1 wherein said hydrophilic image-recording layer is gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), or polyacrylamide or mixtures thereof.

13. The element of claim 1 wherein said overcoat layer is present in an amount of from about 0.25 to about 2.5 $g/m^2$.

14. The element of claim 1 wherein A is methacrylic acid, B is butylacrylate and C is trimethylammonium ethylacrylate, chloride salt.

15. An ink jet printing process comprising:

a) providing an ink jet recording element according to claim 1, and b) applying liquid ink droplets thereon in an image-wise manner.

* * * * *